US008503268B1

(12) United States Patent
Eller

(10) Patent No.: US 8,503,268 B1
(45) Date of Patent: Aug. 6, 2013

(54) FONDUE FORK WITH TIMER

(76) Inventor: Dana Eller, Fort Lauderdale, FL (US)

( * ) Notice: Subject to any disclaimer, the term of this patent is extended or adjusted under 35 U.S.C. 154(b) by 0 days.

(21) Appl. No.: 12/455,755

(22) Filed: Jun. 5, 2009

(51) Int. Cl.
*G04F 10/00* (2006.01)
*G04B 37/12* (2006.01)

(52) U.S. Cl.
USPC ..... 368/113; 368/278; 368/10

(58) Field of Classification Search
USPC ..... 368/10, 107–109, 113–114, 278
See application file for complete search history.

(56) References Cited

U.S. PATENT DOCUMENTS

| | | | | | |
|---|---|---|---|---|---|
| 4,207,673 | A * | 6/1980 | DiGirolamo et al. | ..... | 30/142 |
| 4,731,766 | A * | 3/1988 | Bunyea | ..... | 368/10 |
| 4,930,810 | A * | 6/1990 | Addison, Jr. | ..... | 280/821 |
| D318,625 | S * | 7/1991 | Stowell | ..... | D10/31 |
| 5,075,970 | A * | 12/1991 | Albert | ..... | 30/123 |
| 5,299,356 | A * | 4/1994 | Maxwell, III | ..... | 30/322 |
| 5,421,089 | A * | 6/1995 | Dubus et al. | ..... | 30/142 |
| 6,442,846 | B1 * | 9/2002 | Michael | ..... | 30/322 |
| 6,580,662 | B2 * | 6/2003 | Vassallo | ..... | 368/11 |
| 6,594,908 | B2 * | 7/2003 | Di Amico | ..... | 30/322 |
| D479,807 | S * | 9/2003 | Norcross et al. | ..... | D10/57 |
| 6,675,483 | B2 * | 1/2004 | Bond et al. | ..... | 30/142 |
| 7,409,765 | B2 * | 8/2008 | So | ..... | 30/123 |
| 2008/0043809 | A1 * | 2/2008 | Herbert | ..... | 374/163 |
| 2008/0276398 | A1 * | 11/2008 | Nanda | ..... | 15/167.1 |
| 2010/0271909 | A1 * | 10/2010 | Michaelson | ..... | 368/108 |

FOREIGN PATENT DOCUMENTS

| | | | |
|---|---|---|---|
| DE | 3119798 | * | 5/1981 |
| DE | 29707925 | * | 5/1997 |

* cited by examiner

*Primary Examiner* — Sean Kayes
(74) *Attorney, Agent, or Firm* — Oltman Flynn & Kubler

(57) ABSTRACT

A fork for engaging and holding a food item while the food item is cooking includes an elongate fork body; a fork distal end including at least one tine; a fork proximal end with a fork handle; a stopwatch timer with a timer display mechanism and a timer actuating mechanism for timing the emersion of a food item within a fondue liquid to determine that the food item is cooked sufficiently but not excessively; and a timer power source connected to the timer.

10 Claims, 2 Drawing Sheets

FONDUE FORK WITH TIMER

BACKGROUND OF THE INVENTION

1. Field of the Invention

The present invention relates generally to the field of cooking equipment and utensils. More specifically the present invention relates to a fondue fork for engaging and holding food items while submerging each food item in heated fondue liquid to cook and season the food items, the fondue fork including an elongate fork body and a fork distal end with two fork tines and having a fork proximal end with a handle and a stopwatch timer having a timer actuating means for timing the emersion of a given type of food item within a given fondue liquid to assure that the food item is cooked sufficiently but not excessively. The user may determine through trial and experience what the optimum cooking times are for various types of food items and then immerse each given type of food item for that optimum length of time, or a restaurant may provide suggested optimum times.

The fork handle preferably is elongate in the same direction as the fork body. The stopwatch timer preferably is contained within the fork handle and has a digital timer display panel exposed through a display panel opening in the side of the handle, and the timer actuating means preferably takes the form of a button. The timer includes a timer circuit and a timer power source. The timer circuit is constructed so that depressing the actuating button a first time starts the timer, depressing the actuating button a second time stops the timer so that the timer displays the elapsed time, and depressing the actuating button a third time clears displayed data from the timer display panel so that the timer is ready for the next use.

2. Description of the Prior Art

There have long been forks for engaging food items, and specifically fondue forks for engaging food items while they are dipped into various fondue liquids. A limitation of these prior fondue forks has been that they do not assist the user in determining how long to immerse a given type of food item in a fondue liquid for full but not excessive cooking.

A prior fork which includes a timer is disclosed in Dubus, et al., U.S. Pat. No. 5,421,089, issued on Jun. 6, 1995. Dubus, et al., includes a fork for assisting in weight loss having a countdown timer connected to the fork handle for counting down a pre-programmed time period to alert a user of when to take another bite of food and thus to slow the rate of eating. Dubus, et al., is not suited to measuring cooking times of various fondue food items because the countdown timer measures only one pre-programmed time period and thus different cooking times for different types of food items in different types of fondue liquids cannot be measured and a user is not free to select cooking times at his or her own discretion.

It is thus an object of the present invention to provide a fondue fork which includes a stopwatch timer for timing the immersion of each food item in a fondue liquid, such that an optimum immersion time can be determined and measured for each of various types of food items in each of various types of fondue liquids.

It is another object of the present invention to provide such a fondue fork in which the stopwatch timer is contained within the fork handle to be compact and which exposes a timer display on a handle side surface.

It is still another object of the present invention to provide such a fondue fork in which the timer generates a signal at each of a series of pre-set intervals to alert the user of time elapsed and which optionally displays the current date and time.

It is finally an object of the present invention to provide such a fondue fork which is suitable for measuring cooking times other than immersion time in a fondue liquid, and which is durable and inexpensive to manufacture.

SUMMARY OF THE INVENTION

The present invention accomplishes the above-stated objectives, as well as others, as may be determined by a fair reading and interpretation of the entire specification.

A fork is provided for engaging and holding a food item while the food item is cooking, the fork including an elongate fork body; a fork distal end including at least one tine; a fork proximal end with a fork handle; a stopwatch timer with a timer display mechanism and a timer actuating mechanism for timing the emersion of a food item within a fondue liquid to determine that the food item is cooked sufficiently but not excessively; and a timer power source connected to the timer.

The timer power source preferably includes a battery. The fork handle preferably is elongate in the direction of the fork body longitudinal axis. The stopwatch timer preferably is retained within the fork handle and the timer display mechanism preferably includes a timer display panel. The fork preferably additionally includes a display panel opening in the fork handle through which the display panel is exposed. The fork handle has a handle proximal end and the timer actuating mechanism preferably includes an actuating button protruding from the handle proximal end. The actuating button preferably is contoured to define a rounded handle end.

The fork preferably additionally includes a timer circuit constructed so that depressing the actuating button a first time starts the timer, depressing the actuating button a second time stops the timer so that the timer displays data in the form of the elapsed time since first depressing the actuating button, and depressing the actuating button a third time clears displayed data from the timer display panel for the next use of the timer. The timer circuit preferably additionally includes a signal emitting mechanism and interval measuring and signalling mechanism which delivers power to and activates the signal emitting mechanism momentarily at fixed intervals. The signal emitting mechanism preferably is one of: a light emitting source and a sound emitting source.

The light emitting source preferably is mounted to the timer actuating button so that the light emitting source is visible. The timer circuit optionally additionally includes calendar and time storing capability which keeps and displays on the timer display mechanism the date and the time of day. The fork distal end preferably includes at least two tines.

The stopwatch timer alternatively is mechanical and the timer power source in this instance preferably includes a spring. The timer display mechanism preferably includes a timer face having time calibrations and a rotating timer hand positioned over the timer face.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
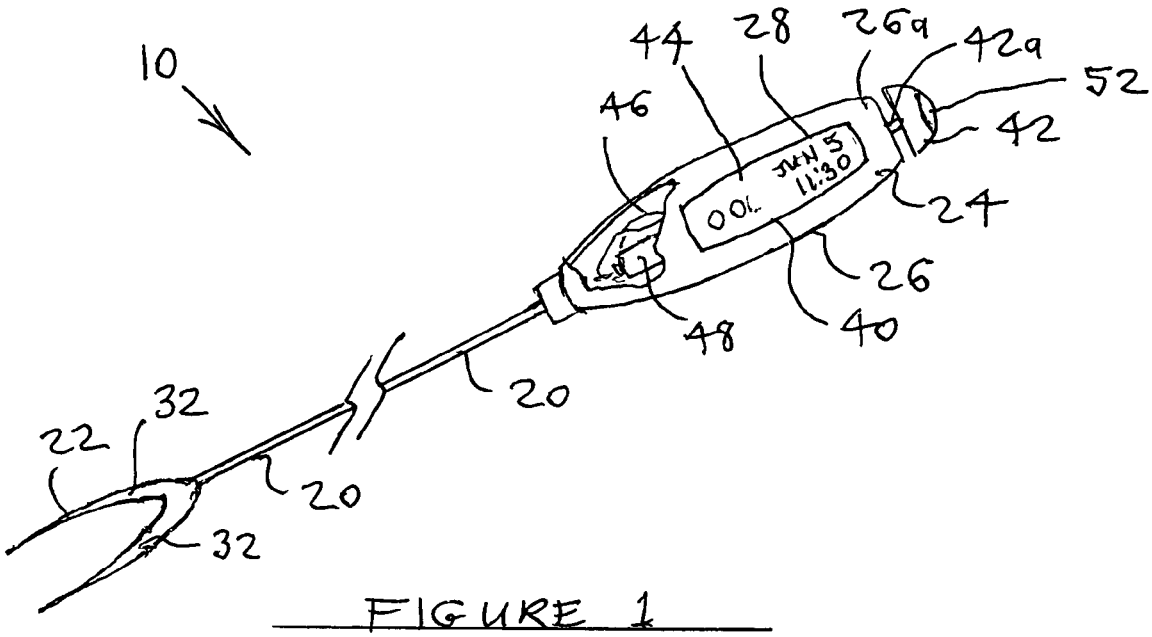
FIG. 1 is a side view of a first embodiment of the inventive fondue fork equipped with an electronic stopwatch timer, a timer actuating button and a timer circuit having a digital display panel and a light emitting diode in the timer actuating button.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
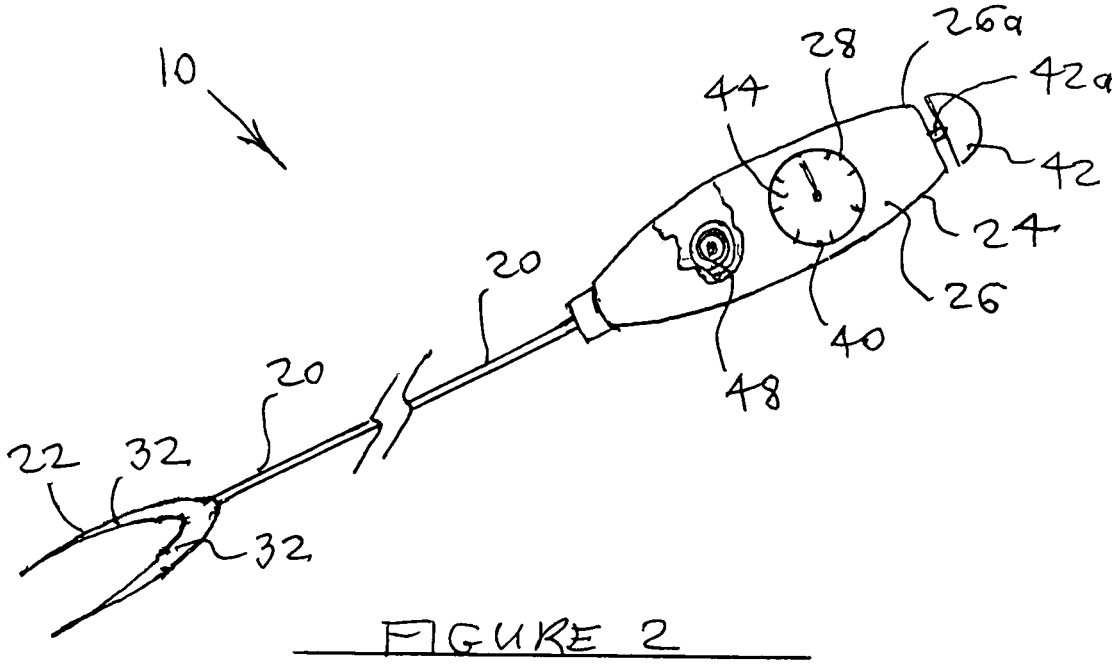
FIG. 2 is a view as in FIG. 1 of another variation of the fondue fork equipped with a mechanical, spring driven stopwatch timer and a display panel in the form of a stopwatch face marked with circumferential time calibrations and having a rotating hand.

Referring to FIGS. 1-2, a fondue fork 10 for engaging and holding food items submerged in heated fondue liquid and for measuring the time of submersion of a given type of food item within a given fondue liquid to assure that the food item is cooked sufficiently but not excessively is disclosed. Fondue fork 10 includes an elongate fork body 20, preferably in the form of a metal or plastic rod, having a fork distal end 22 with at least one and preferably two fork tines 32 and having a fork proximal end 24 with a fork handle 26 and a stopwatch timer 40 having a timer actuating means for measuring the time of food item emersion and time indicating means 44 for displaying the measured time.

The fork handle 26 preferably is elongate in the same direction as the fork body 20, and the stopwatch timer 40 preferably is contained within the fork handle 26. The timer indicating means 44 preferably includes a timer display panel 44 exposed through a display panel opening 28 in the side of the fork handle 26. The timer actuating means preferably takes the form of an actuating button 42 protruding from the fork handle proximal end 26*a* and preferably mounted on a button stem 42*a* to the depressible and being spring loaded to return to its original extended position when released, and preferably is contoured to define a rounded handle 26 end. The timer 40 includes a timer power source 46.

The timer 40 preferably is constructed so that depressing the actuating button 42 a first time starts the timer 40, depressing the actuating button 42 a second time stops the timer 40 so that the timer display panel 44 displays the time elapsed following first depressing the actuating button 42, and depressing the actuating button 42 a third time clears displayed data from the timer display panel 44 for the next use, these functions preferably being provided by a timer circuit 46. Where a timer circuit 46 is provided, the actuating button is connected to a timer switch controlling actuation of the timer circuit 46. The timer circuit 46 optionally includes signal emitting means preferably in the form of a light emitting diode (LED) 52 and interval measuring and signalling means which delivers power to and lights the LED 52 momentarily at fixed intervals, such as at one minute intervals. The LED 52 preferably is mounted to or is set into a recess in timer actuating button 42 and oriented relative to the timer actuating button 42 to be visible.

Another signal emitting means is an optional sound source 54 of conventional design for electronic circuits connected to the interval measuring and signalling means to sound momentarily at the fixed intervals. The timer circuit 46 also optionally includes calendar storing and date counting means which displays date and time of day data on the timer display panel 44. Where the timer 40 contains a circuit 46, the timer power source 48 preferably takes the form of a battery, which may be permanent, replaceable or non-replaceable, rechargeable or non-rechargeable. While an electronic timer 40 is preferred, the use of a mechanical timer 40 such as a spring driven timer with a rotating timer hand over a timer face with time calibrations along the face periphery or rotating timer number display wheels is also contemplated.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A fork for engaging and holding a food item while the food item is cooking, comprising:
- an elongate fork body;
- a fork distal end comprising at least two tines configured to retain food within a heated fondue liquid;
- a fork proximal end with a fork handle;
- the fork handle comprises:
- a stopwatch timer;
- a timer power source;
- a stopwatch timer display;
- an actuator button protruding from a proximal end of said handle; and
- a timer control circuit configured to perform a start, stop, and reset stopwatch timing operation respectively responsive to a sequential operation of the actuator button.

2. The fork of claim 1, wherein said timer power source comprises a battery.

3. The fork of claim 1, wherein said fork handle is elongate in the same direction as said fork body.

4. The fork of claim 1, wherein said stopwatch timer is retained within said fork handle and wherein said timer display means comprises a timer display panel.

5. The fork of claim 4, additionally comprising a display panel opening in said fork handle through which said display panel is exposed.

6. The fork of claim 1, wherein said actuating button is contoured to define a rounded handle end.

7. The fork of claim 1, additionally comprising a signal emitting means and interval measuring and signalling means which delivers power to and activates said signal emitting means momentarily at fixed intervals.

8. The fork of claim 7, wherein said signal emitting means is one of: a light emitting source and a sound emitting source.

9. The fork of claim 8, wherein said light emitting source is mounted to said timer actuating button such that said light emitting source is visible.

10. The fork of claim 1, wherein said timer circuit additionally comprises calendar means which keeps and displays on the timer display the date and time of day.

* * * * *